US012740679B2

(12) United States Patent
Chen

(10) Patent No.: US 12,740,679 B2
(45) Date of Patent: Sep. 22, 2026

(54) AIRBRUSH VACUUM KIT

(71) Applicant: Chin-Nan Chen, Keelung City (TW)

(72) Inventor: Chin-Nan Chen, Keelung City (TW)

( * ) Notice: Subject to any disclaimer, the term of this patent is extended or adjusted under 35 U.S.C. 154(b) by 300 days.

(21) Appl. No.: 18/392,376

(22) Filed: Dec. 21, 2023

(65) Prior Publication Data

US 2024/0306870 A1 Sep. 19, 2024

(30) Foreign Application Priority Data

Mar. 14, 2023 (TW) ..... 112202222
Sep. 13, 2023 (TW) ..... 112209913

(51) Int. Cl.

| | |
|---|---|
| ***A47L 9/06*** | (2006.01) |
| ***A47L 7/00*** | (2006.01) |
| ***A47L 9/02*** | (2006.01) |
| ***A47L 9/10*** | (2006.01) |
| ***A47L 9/14*** | (2006.01) |

(52) U.S. Cl.

CPC ..... *A47L 9/06* (2013.01); *A47L 9/102* (2013.01); *A47L 9/1481* (2013.01); *A47L 7/0004* (2013.01)

(58) Field of Classification Search

CPC ..... B05B 3/06; B05B 7/2435; B05B 14/30; B05B 3/0204; B05B 7/066; B05B 3/00; B05B 15/16; B05B 3/04; B05B 7/2491; B05B 1/005; B05B 1/28; B05B 7/02; B05B 7/045; B05B 7/064; B05B 12/002; B05B 14/00; B05B 7/0075; B05B 7/0081; B05B 7/0416; B05B 7/0441; B05B 7/2459; B08B 3/028; B08B 2203/0229; B08B 3/026; B08B 5/02; B08B 5/04; B08B 1/40; B08B 1/12; B08B 3/02; A47L 9/02; A47L 11/201; A47L 7/0004; A47L 7/009; A47L 7/0095; A47L 9/06; A47L 9/102; A47L 9/1481; A47L 1/02; A47L 9/08; B23Q 11/0071; B24C 3/065; B60S 3/044

See application file for complete search history.

(56) References Cited

U.S. PATENT DOCUMENTS 2,270,579 A * 1/1942 Chamberlin ..... B05B 14/00 239/105
5,533,673 A * 7/1996 Wilson ..... B05B 3/04 239/227

(Continued)

*Primary Examiner* — Eric J Zamora Alvarez
(74) *Attorney, Agent, or Firm* — MUNCY, GEISSLER, OLDS & LOWE, P.C.

(57) ABSTRACT

An airbrush vacuum kit includes a barrel assembling tube, a vacuum adapter tube and a dust collector. The barrel assembling tube includes an assembling-tube body and an inclined extension tube. The assembling-tube body extends from a first assembling port to a second assembling port along a first direction. The first assembling port is to assemble a barrel of a fluid spray gun. The inclined extension tube protrudes from the adapter-tube body along a second direction oblique to the first direction. The vacuum adapter tube includes an adapter-tube body, a first connecting port and a second connecting port. The first connecting port protrudes from the adapter-tube body for being assembled to the inclined extension tube. The second connecting port protrudes from the adapter-tube body for being assembled to a hose of a vacuum. The dust collector is rotationally assembled to the second assembling port.

9 Claims, 10 Drawing Sheets

(56) References Cited

U.S. PATENT DOCUMENTS

| | | | | |
|---|---|---|---|---|
| 6,883,732 | B2 * | 4/2005 | Hasegawa | B05B 3/00 239/602 |
| 9,211,560 | B1 * | 12/2015 | Chen | B08B 3/026 |
| 9,751,098 | B2 * | 9/2017 | Fu | B05B 3/06 |
| 9,861,993 | B2 * | 1/2018 | Fu | B05B 1/005 |
| 10,259,002 | B1 * | 4/2019 | Kuo | B05B 7/2459 |
| 11,931,760 | B2 * | 3/2024 | Wang | B05B 7/0483 |
| D1,089,918 | S * | 8/2025 | Chen | D32/32 |
| D1,102,556 | S * | 11/2025 | Chen | D32/21 |
| 2022/0134366 | A1 * | 5/2022 | Pieroni | B05B 3/06 239/8 |
| 2024/0308012 | A1 * | 9/2024 | Chen | B23Q 11/0071 |

* cited by examiner

AIRBRUSH VACUUM KIT

This application claims the benefit of Taiwan Patent Applications Serial No. 112202222 and 112209913, filed on Mar. 14, 2023, and Sep. 13, 2023, respectively, these subject matters of which are incorporated herein by reference.

BACKGROUND OF THE INVENTION

(1) Field of the Invention

The invention relates to an airbrush vacuum kit, and more particularly to an airbrush vacuum kit for assembling a fluid spray gun and a vacuum.

(2) Description of the Prior Art

In daily life, when people clean their home environment, the negative pressure generated by the vacuum is usually used to absorb dust, debris and/or other dirt from the floor or desktop surface to be cleaned. However, while in using the vacuum to absorb these dirt, definitely some dirt would be stubbornly adhered to a surface of the object, and it is likely to be ignored due to the size. Particularly, the dirt adhering the surface would become more difficult to remove over time.

Generally speaking, the common way to remove these dirt is to scrape off the dirt through direct contact. However, such a method is not only time-consuming and labor-intensive. On the other hand, an airbrush vacuum kit capable of integrating a spray gun and a vacuum is introduced. The airbrush vacuum kit allows users to firstly use a fluid ejected from the spray gun to impact and thus loosen the dirt, and then the vacuum is applied to suck away the dirt, which is not only more labor-saving but also more efficient.

As described above, as a spray gun is combined with the vacuum through the airbrush vacuum kit, the dirt may be sprayed up by the spray gun and then sucked away by the vacuum. However, in actual operation, to avoid the dirt being sprayed around, a dust collector of the airbrush vacuum kit is opened to cover the surface to be cleaned, and then the negative pressure generated by the vacuum would be used to suck away the dirt in the dust collector. Anyhow, though the open cover of the dust collector is to cover the surface to be cleaned so as to effectively prevent the dirt from flying, yet it is also easy to generate a vacuum-like state to the dust collector and the surface to be cleaned due to the negative pressure of the vacuum. As such, the dust collector is hard to move for a large-scale cleaning.

SUMMARY OF THE INVENTION

In view of the fact that, in the previous technology, the existing spray gun and vacuum can be though used in combination with the airbrush vacuum kit, but the negative pressure generated by the vacuum will cause the entire dust collector to be tightly attached to the floor when the dust collector's opening cover covers the surface to be cleaned. Thus, the efficiency of cleaning would be significantly affected. Accordingly, it is an object of the present invention to provide an airbrush vacuum kit that can prevent the dust collector from tightly adhering to the surface to be cleaned, and thus the operational convenience can be promoted.

In accordance with this present invention, an airbrush vacuum kit is assembled to a fluid spray gun and configured for selectively collecting at least one dirt leaving an object surface or guiding the at least one dirt to a vacuum after the fluid spray gun injects a fluid onto the object surface. The airbrush vacuum kit includes a barrel assembling tube, a dust collector, a vacuum adapter tube and a dust-collecting bag.

The barrel assembling tube includes an assembling-tube body and an inclined extension tube. The assembling-tube body is extended from a first assembling port to a second assembling port along a first direction. The first assembling port is configured for being assembled to a barrel of the fluid spray gun, while the second assembling port is spatially connected with the first assembling port. The inclined extension tube is protruded from the assembling-tube body along a second direction oblique to the first direction.

The dust collector includes a collector body and a plurality of raised structures. The collector body is rotationally assembled to the second assembling port, and has an open end. The plurality of raised structures are protruded from the open end by being spaced apart from each other to form a plurality of fluid flow gaps upon when the plurality of raised structures contact the object surface.

The vacuum adapter tube includes an adapter-tube body, a first connecting port and a second connecting port. The first connecting port is protruded from the adapter-tube body along a third direction, and configured for being rotationally assembled to the inclined extension tube upon when the at least one dirt is guided to the vacuum. The second connecting port is protruded from the adapter-tube body along a fourth direction oblique to the third direction, and configured for being assembled to the vacuum.

The dust-collecting bag is configured for being assembled to the inclined extension tube upon when the airbrush vacuum kit collects the at least one dirt.

In one embodiment of the present invention, the dust-collecting bag includes a bag connector and a bag body. The bag connector is configured for being assembled to the inclined extension tube. The bag body is connected with the bag connector, and has a connecting chamber. Preferably, the bag body is made of non-woven fabric.

In one embodiment of the present invention, the assembling-tube body has a hollow pipe way for the barrel to penetrate therethrough, the first assembling port has a locking hole, and the locking hole is spatially connected with the hollow pipe way, so that a lock firmware can penetrate through and lock the barrel while the barrel penetrates through the hollow pipe way.

In one embodiment of the present invention, the second assembling port has a first outer tube wall, the dust collector has a first inner tube wall, and the first inner tube wall and the first outer tube wall are matched to each other. Preferably, the first outer tube wall and the first inner tube wall are individually tapering along the first direction.

In one embodiment of the present invention, the collector body further includes a tube section and an expanding section. The tube section is extended along the first direction, and has the first inner tube wall. The expanding section is connected spatially with the tube section, and gradually expanded along the first direction.

In one embodiment of the present invention, the inclined extension tube has a second inner tube wall, the first connecting port has a second outer tube wall, and the second outer tube wall and the second inner tube wall are matched to each other. Preferably, the second inner tube wall is gradually expanded along the second direction, the second outer tube wall is tapering along the third direction, and the second direction and the third direction are opposite to each other upon when the first connecting port is assembled to the inclined extension tube.

As stated, since the airbrush vacuum kit of this invention is to dispose a plurality of raised structures at the open end of the dust collector, thus a plurality of fluid flow gaps would be formed while the dust collector is attached onto the object surface. Thereupon, difficult movement of the dust collector caused by excessive pressure difference would be avoided, and thus the use convenience can be effectively promoted.

All these objects are achieved by the airbrush vacuum kit described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to an airbrush vacuum kit. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
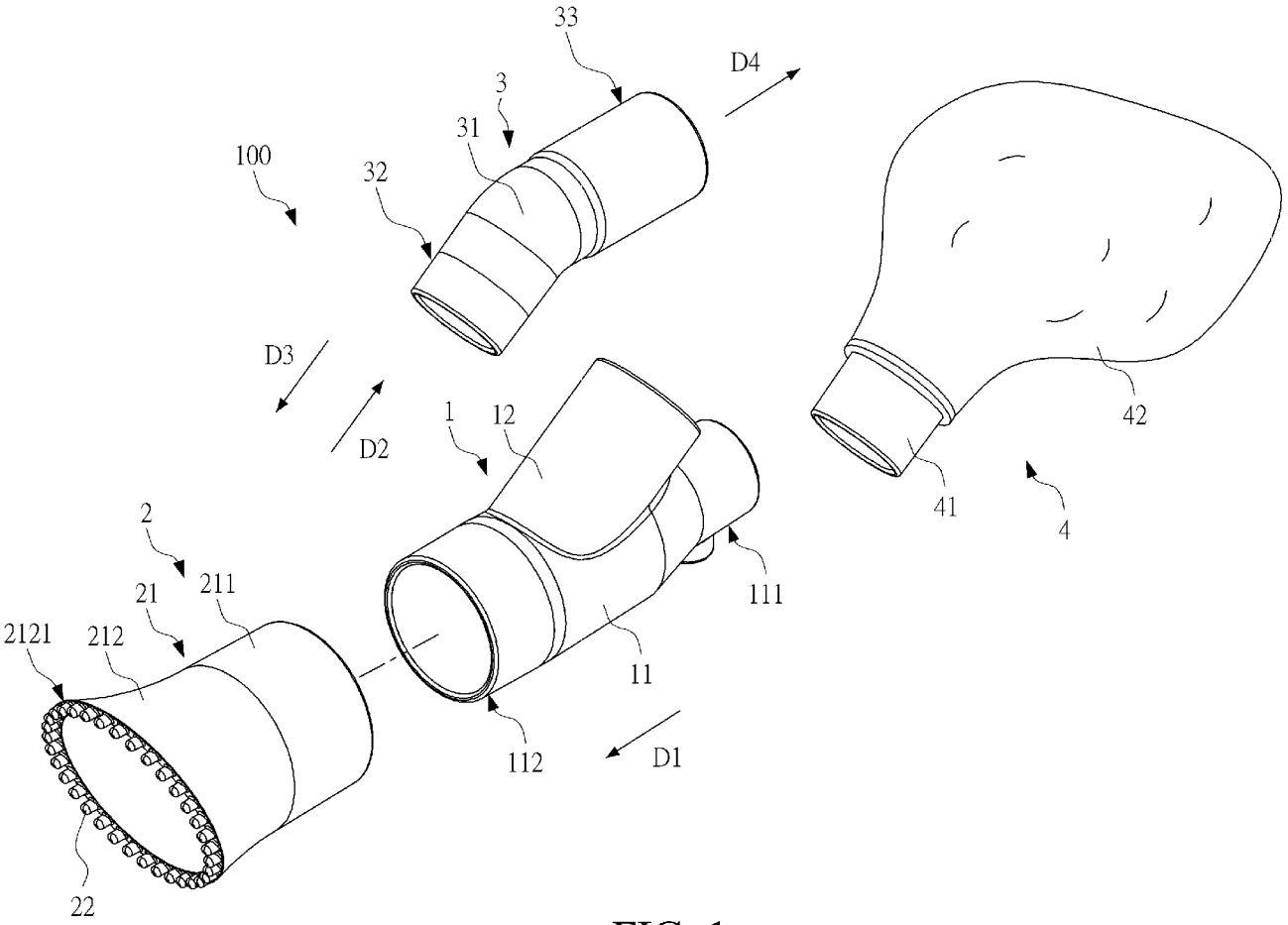
FIG. 1 is a schematic exploded view of a preferred embodiment of the airbrush vacuum kit in accordance with the present invention.
Figure 2:
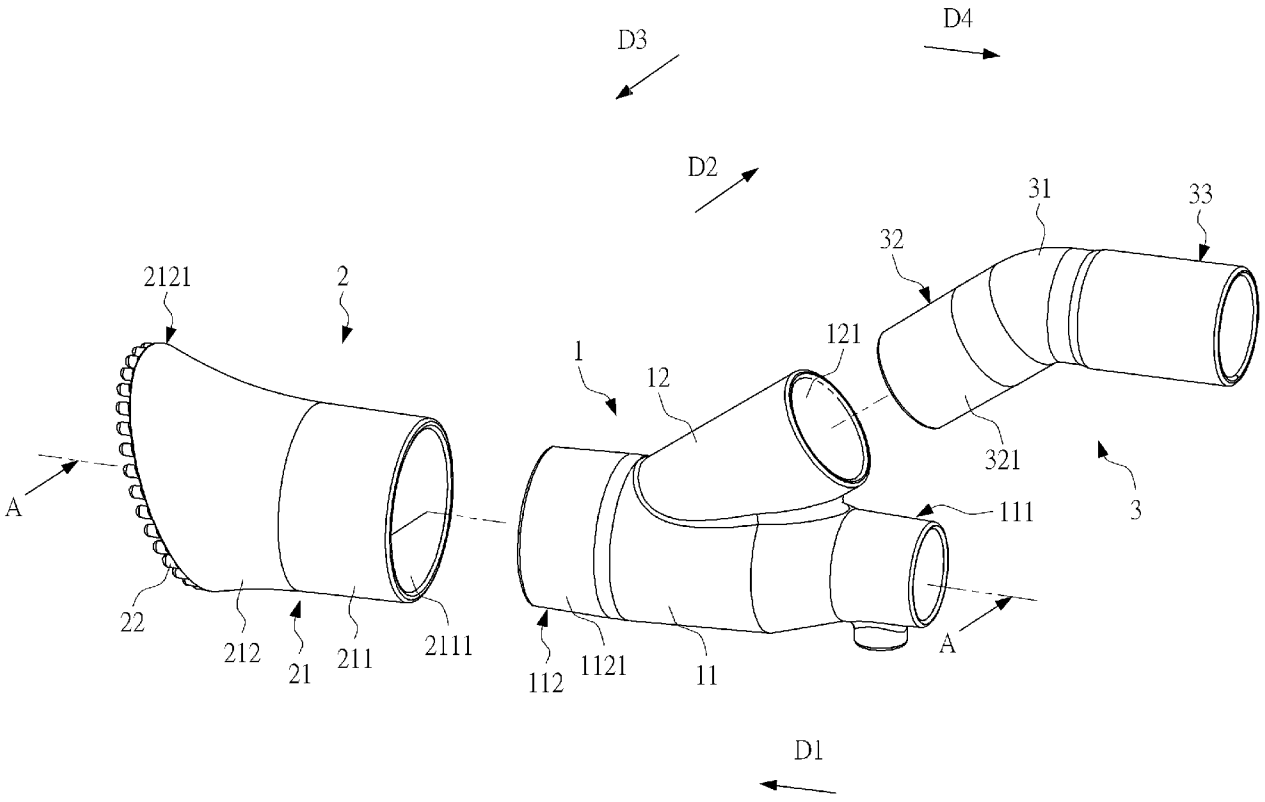
FIG. 2 is a schematic exploded view of assembling of the barrel assembling tube, the vacuum adapter tube and the dust collector of FIG. 1.
Figure 3:
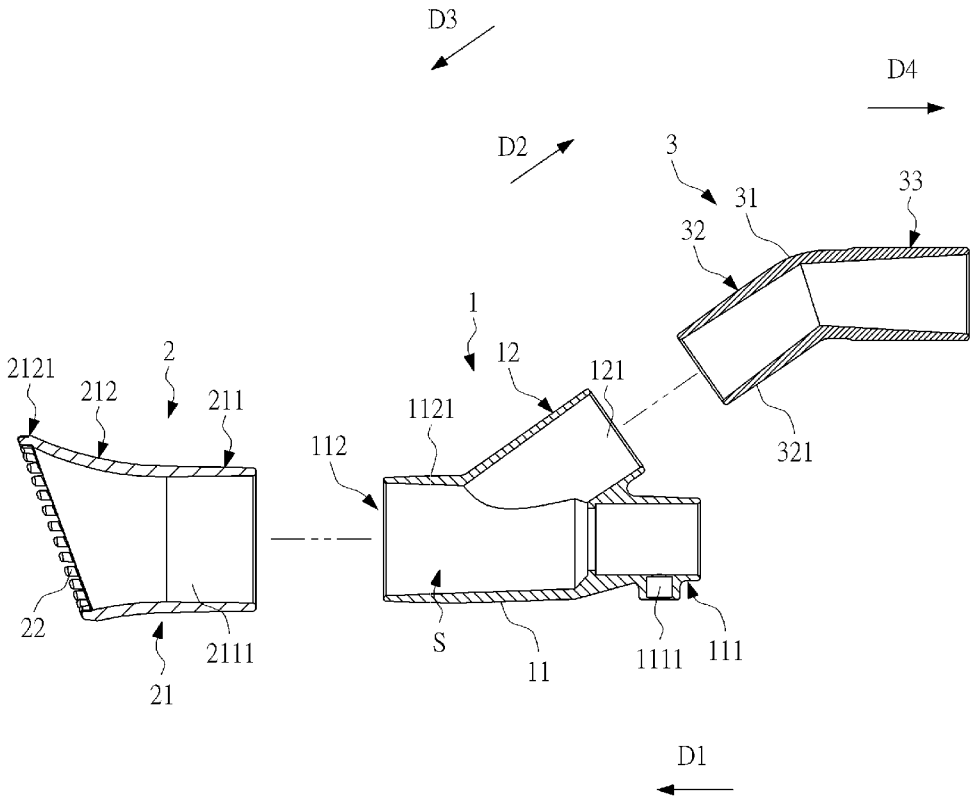
FIG. 3 is a schematic cross-sectional view of FIG. 2 along line A-A.

Refer to FIG. 1 to FIG. 3; where FIG. 1 is a schematic exploded view of a preferred embodiment of the airbrush vacuum kit in accordance with the present invention, FIG. 2 is a schematic exploded view of assembling of the barrel assembling tube, the vacuum adapter tube and the dust collector of FIG. 1, and FIG. 3 is a schematic cross-sectional view of FIG. 2 along line A-A. As shown, in this embodiment, an airbrush vacuum kit 100 includes a barrel assembling tube 1, a dust collector 2, a vacuum adapter tube 3 and a dust-collecting bag 4.

The barrel assembling tube 1 includes an assembling-tube body 11 and an inclined extension tube 12. The assembling-tube body 11 is extended from a first assembling port 111 thereof to a second assembling port 112 thereof along a first direction D1, and has a hollow pipe way S spatially connecting the first assembling port 111 and the second assembling port 112. As shown, the first assembling port 111 further has a locking hole 1111. In addition, the second assembling port 112 has a first outer tube wall 1121.

The inclined extension tube 12 is protruded from the assembling-tube body 11 along a second direction D2 oblique to the first direction D1, and the inclined extension tube 12 has a second inner tube wall 121.

The dust collector 2 includes a collector body 21 and a plurality of raised structures 22 (one labeled in the figure). The collector body 21 includes a tube section 211 and an expanding section 212. The tube section 211 is extended along the first direction D1, and has a first inner tube wall 2111. The first inner tube wall 2111 and the first outer tube wall 1121 are matched to each other, such that the tube section 211 can be tightly fitted with the second assembling port 112. The expanding section 212 is spatially connected with tube section 211, and is gradually expanded along the first direction D1 to finally form an open end 2121. A plurality of raised structures 22, protruding individually from an end surface of the open end 2121, are spaced apart from each other.

In addition, in this embodiment, the first connecting port 32 further has a second outer tube wall 321 for matching the second inner tube wall 121 to each other, such that the first connecting port 32 can be tightly fitted with the inclined extension tube 12.

The dust-collecting bag 4 includes a bag connector 41 and a bag body 42. The bag connector 41 is configured for being assembled to the inclined extension tube 12. The bag body 42 is connected with the bag connector 41. In particular, the bag body 42 of this embodiment can be made of a non-woven fabric for achieving a breathable effect.

As described, in this embodiment, while in application, one of the vacuum adapter tube 3 and the dust-collecting bag 4 are selected to be assembled to the inclined extension tube 12, not assembled simultaneously to the inclined extension tube 12.

Figure 4:
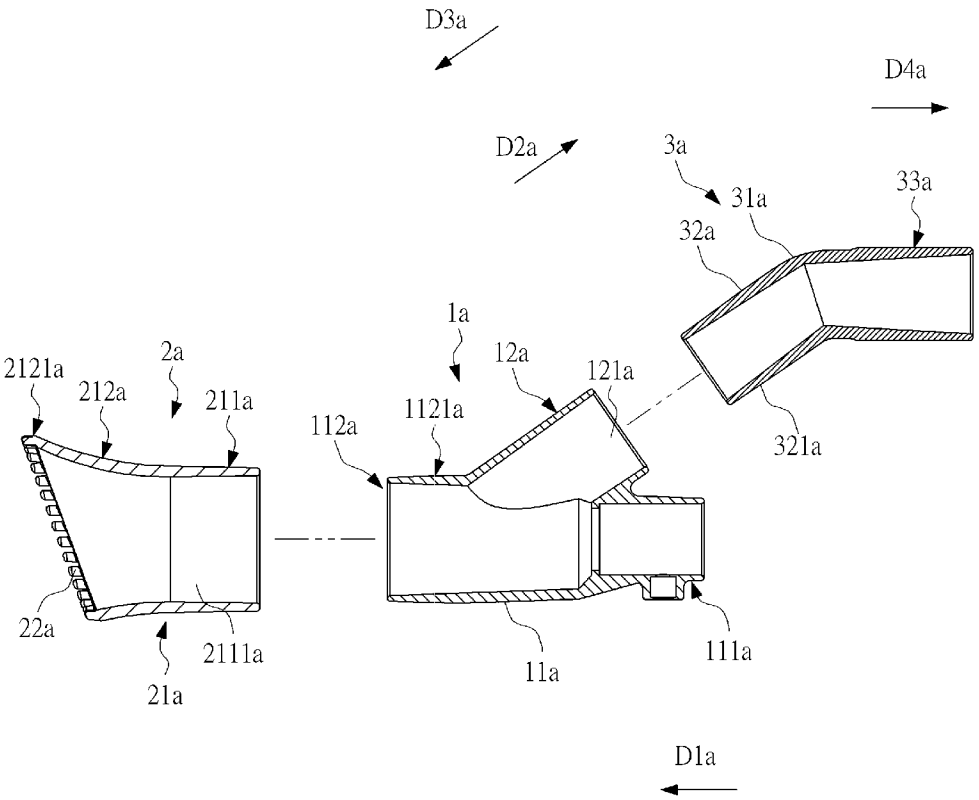
FIG. 4 is a schematic cross-sectional of assembling of a barrel assembling tube, a vacuum adapter tube and a dust collector of another embodiment of the airbrush vacuum kit in accordance with the present invention.

Referring to FIG. 4, a schematic cross-sectional of assembling of a barrel assembling tube, a vacuum adapter tube and a dust collector of another embodiment of the airbrush vacuum kit in accordance with the present invention is shown. As illustrated from FIG. 2 to FIG. 4, in this embodiment, the aforesaid barrel assembling tube 1, dust collector 2 and vacuum adapter tube 3 of the previous embodiment can be individually replaced by a barrel assembling tube 1*a*, a dust collector 2*a* and a vacuum adapter tube 3*a*.

As described, similarly, the barrel assembling tube 1*a* has an assembling-tube body 11*a* and an inclined extension tube 12*a*. The assembling-tube body 11*a* is extended from a first assembling port 111*a* thereof to a second assembling port 112*a* thereof along a first direction D1*a*. In addition, the second assembling port 112*a* has a first outer tube wall 1121*a*. The inclined extension tube 12*a* is protruded from the assembling-tube body 11*a* along a second direction D2*a* oblique to the first direction D1*a*, and the inclined extension tube 12*a* has a second inner tube wall 121*a*. However, the difference between the barrel assembling tube 1*a* and the barrel assembling tube 1 is that, in this embodiment, the first outer tube wall 1121*a* is tapering along the first direction D1*a*, while the second inner tube wall 121*a* is tapering along a reverse direction of the second direction D2*a*.

On the other hand, similarly, the dust collector 2*a* includes a collector body 21*a* and a plurality of raised structures 22*a* (one labeled in the figure). The collector body 21*a* includes a tube section 211*a* and an expanding section 212*a*. The tube section 211*a* is extended along the first direction D1*a*, and has a first inner tube wall 2111*a*. The first inner tube wall 2111*a* and the first outer tube wall 1121*a* are matched to each other, such that the tube section 211*a* can be tightly fitted with the second assembling port 112*a*. The expanding section 212*a* is spatially connected with tube section 211*a*, and is gradually expanded along the first direction D1*a* to finally form an open end 2121*a*. A plurality of raised structures 22*a*, protruding individually from an end surface of the open end 2121*a*, are spaced apart from each other. However, the difference between the dust collector 2*a* of this embodiment and the aforesaid dust collector 2 of the previous embodiment is that, in this embodiment, each of the first outer tube wall 1121*a* and the first inner tube wall 2111*a* is tapering along the first direction D1*a*. Thereupon, when the tube section 211*a* is fitted to the second assembling port 112*a*, the tapering first outer tube wall 1121*a* and first inner tube wall 2111*a* along the first direction D1*a* can be used for guiding the tube section 211*a* to be smoothly engaged with the second assembling port 112*a*, and such an engagement between the tube section 211*a* and the second assembling port 112*a* can be further tightened if the assembling forcing in between is increased.

In addition, the vacuum adapter tube 3*a* includes an adapter-tube body 31*a*, a first connecting port 32*a* and a second connecting port 33*a*. The first connecting port 32*a*, extended from the adapter-tube body 31*a* along a third direction D3*a*, is configured for being rotationally assembled to the inclined extension tube 12*a*. The second connecting port 33*a* is protruded from the adapter-tube body 31*a* along a fourth direction D4*a* oblique to the third direction D3*a*. However, the difference between the vacuum adapter tube 3*a* and the aforesaid vacuum adapter tube 3 is that, in this embodiment, the second inner tube wall 121*a* is tapering along a reverse direction of the second direction D2*a*, while the second outer tube wall 321*a* is tapering along the third direction D3*a*. Thereupon, while the first connecting port 32*a* is plugged to engage the inclined extension tube 12*a*, the second inner tube wall 121*a* and the second outer tube wall 321*a* can be used to guide the first connecting port 32*a* to smoothly engage the inclined extension tube 12*a*, and such an engagement can be further tightened if the assembling forcing in between is increased.

Figure 5:
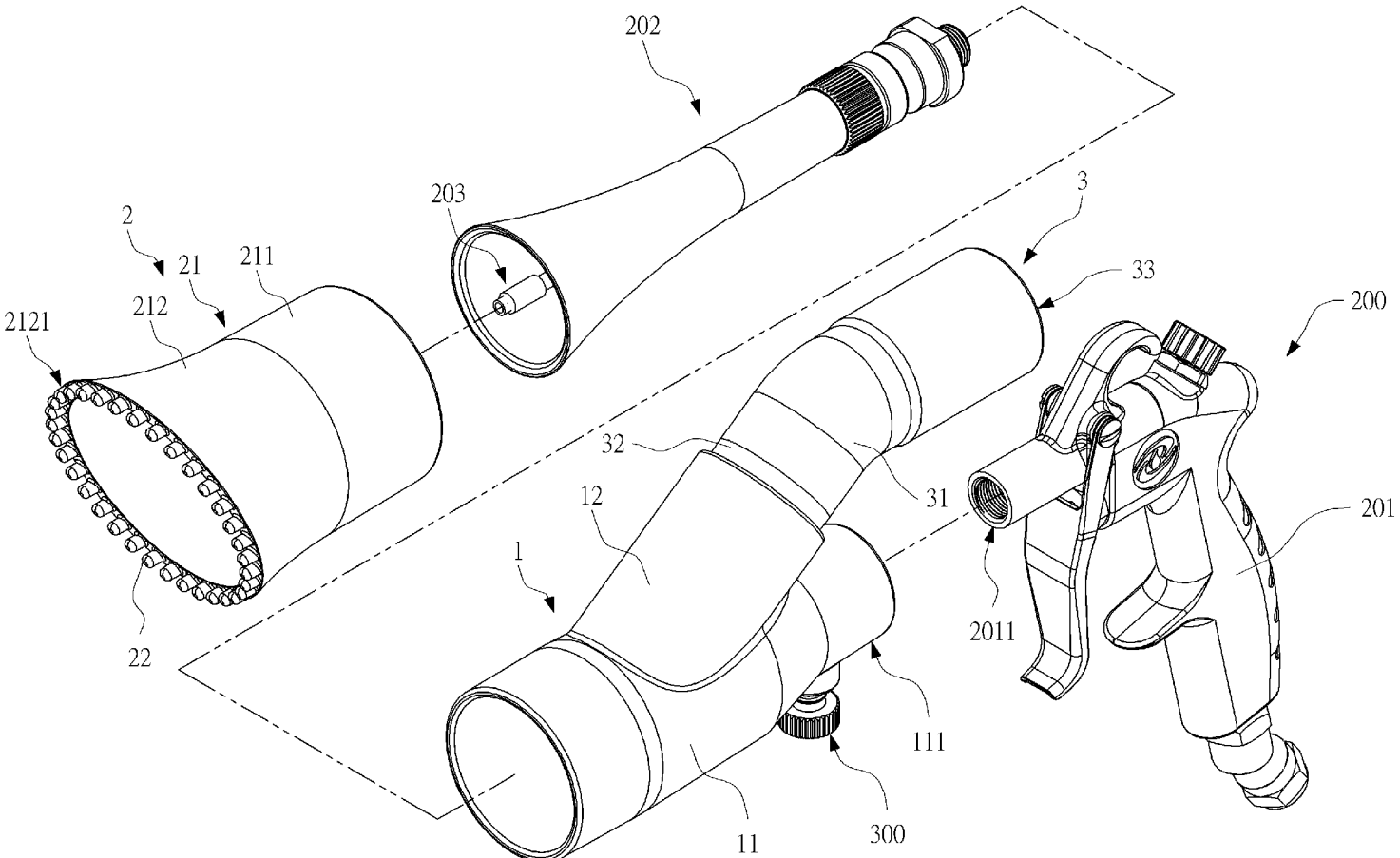
FIG. 5 is a schematic exploded view of a combination of the barrel assembling tube, the dust collector and the vacuum adapter tube of FIG. 1 and a fluid spray gun.
Figure 6:
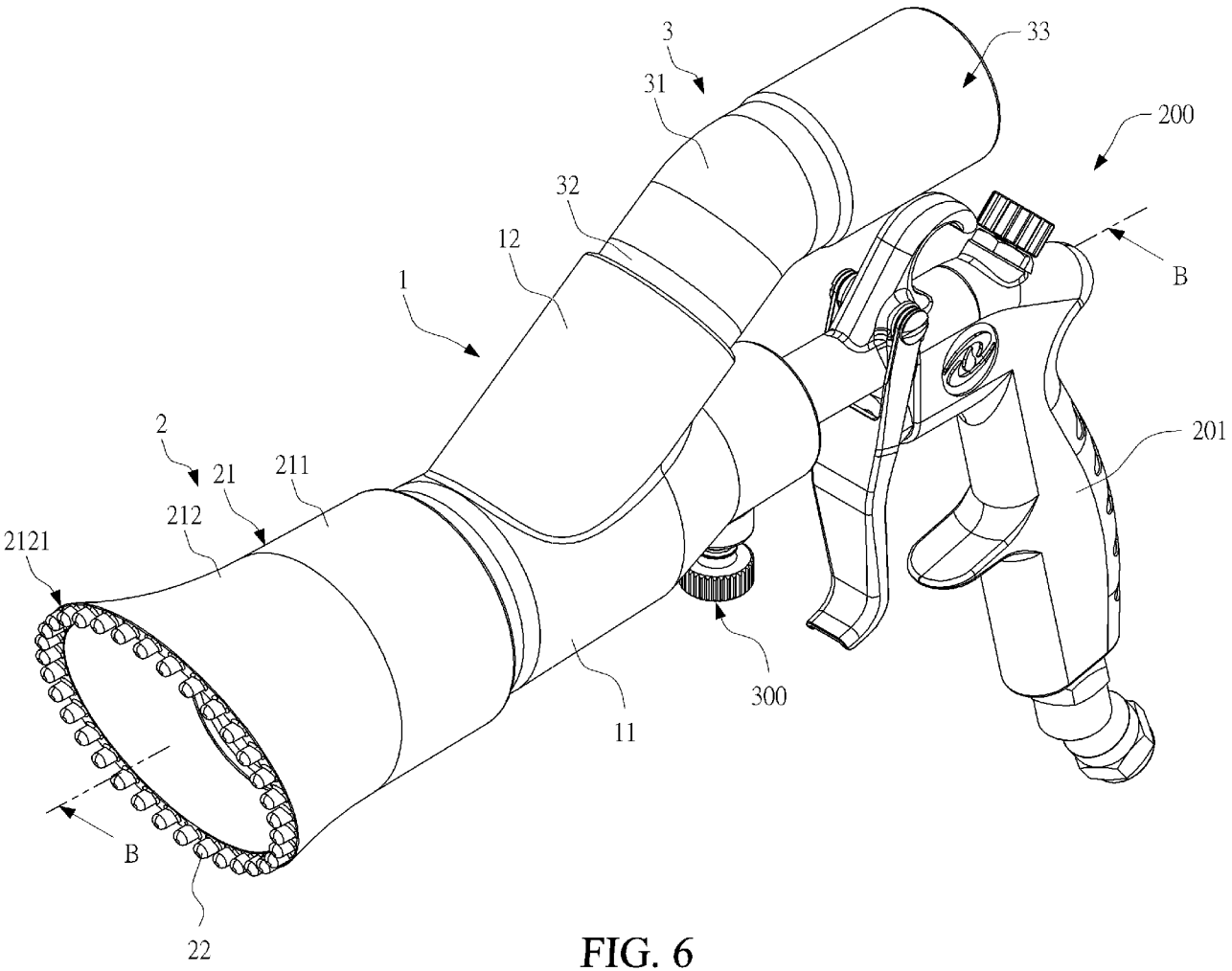
FIG. 6 is a perspective view of FIG. 5.
Figure 7:
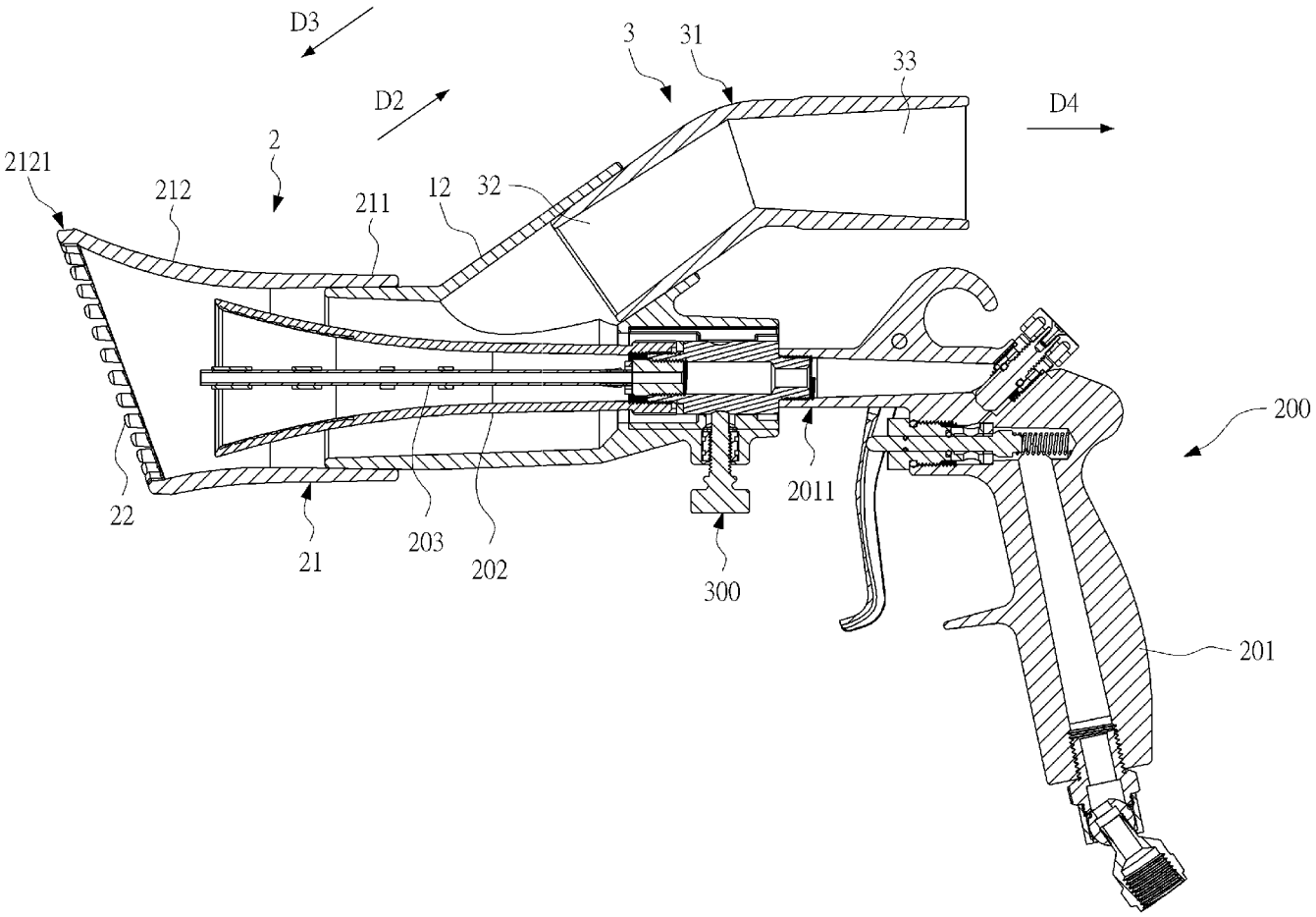
FIG. 7 is a schematic cross-sectional view of FIG. 6 along line B-B.
Figure 8:
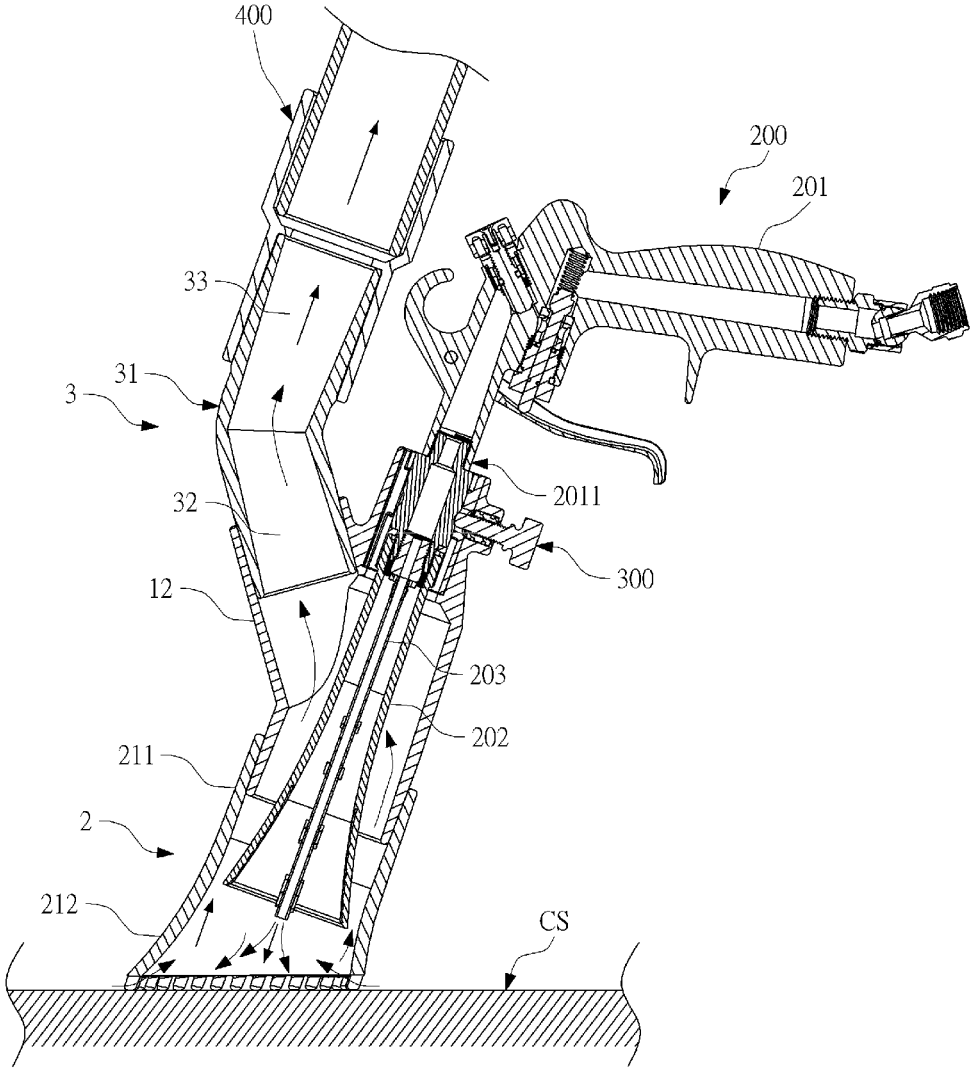
FIG. 8 shows schematically that the combination of FIG. 6 connected with a vacuum is applied to have the dust collector to adhere an object surface for cleaning.

Referring to FIG. 5 to FIG. 8; where FIG. 5 is a schematic exploded view of a combination of the barrel assembling tube, the dust collector and the vacuum adapter tube of FIG. 1 and a fluid spray gun, FIG. 6 is a perspective view of FIG. 5, FIG. 7 is a schematic cross-sectional view of FIG. 6 along line B-B, and FIG. 8 shows schematically that the combination of FIG. 6 connected with a vacuum is applied to have the dust collector to adhere an object surface for cleaning.

Referring to FIG. 1 to FIG. 8, in this embodiment, the airbrush vacuum kit 100 is applied to be assembled to a fluid spray gun 200 including a gun handle 201, a barrel 202 and an air guide nozzle 203.

The gun handle 201 is configured to connect a high-pressure air source (not shown in the figure). The barrel 202 is to penetrate through the barrel assembling tube 1, and a lock firmware 300 is applied to lock at a first assembling end 111. The air guide nozzle 203 is fixed inside the barrel 202, and assembled to a jet port 2011 of the gun handle 201 for connecting spatially the jet port 2011. When a trigger (not labeled in the figure) of the gun handle 201 is pulled, the gun handle 201 would connect spatially the high-pressure source to the jet port 2011, and thus the high-pressure air can be conveyed to eject via the air guide nozzle 203.

As described, while a vacuum 400 (only a hose of the vacuum shown in the figure) is determined for the application, the first assembling port 32 of the vacuum adapter tube 3 is rotationally assembled to the inclined extension tube 12, and the vacuum 400 is assembled to the second assembling port 33, such that the vacuum 400 can be spatially connected with both the barrel assembling tube 1 and the dust collector 2.

After the fluid spray gun 200 is assembled to the vacuum 400 via the barrel assembling tube 1 and the vacuum adapter tube 3, the dust collector 2 can be adhered to an object surface CS, thus a plurality of raised structures 22 would contact the object surface CS so as to form a plurality of fluid flow gaps (not labeled in the figure, but the spacing between any two neighboring raised structures 22).

Practically, in the art, while the high-pressure air provided by fluid spray gun 200 is ejected to the object surface CS via the air guide nozzle 203, the dirt (not shown in the figure) on the object surface CS would be disturbed to spray and further be driven into the vacuum 400 by vacuuming. However, with the dust collector 2 to include the raised structures 22 in accordance with the present invention, the open end 2121 won't be tightly adhered to the object surface CS, and thus, even the vacuuming effect provided by the vacuum 400 is still significant, the fluid flow gaps formed between the plurality of raised structures 22 would allow foreign air to enter the dust collector 2 for modulating the internal pressure, such that the aforesaid problem in difficultly moving the dust collector 2 due to the pressure difference would be overcome.

Figure 9:
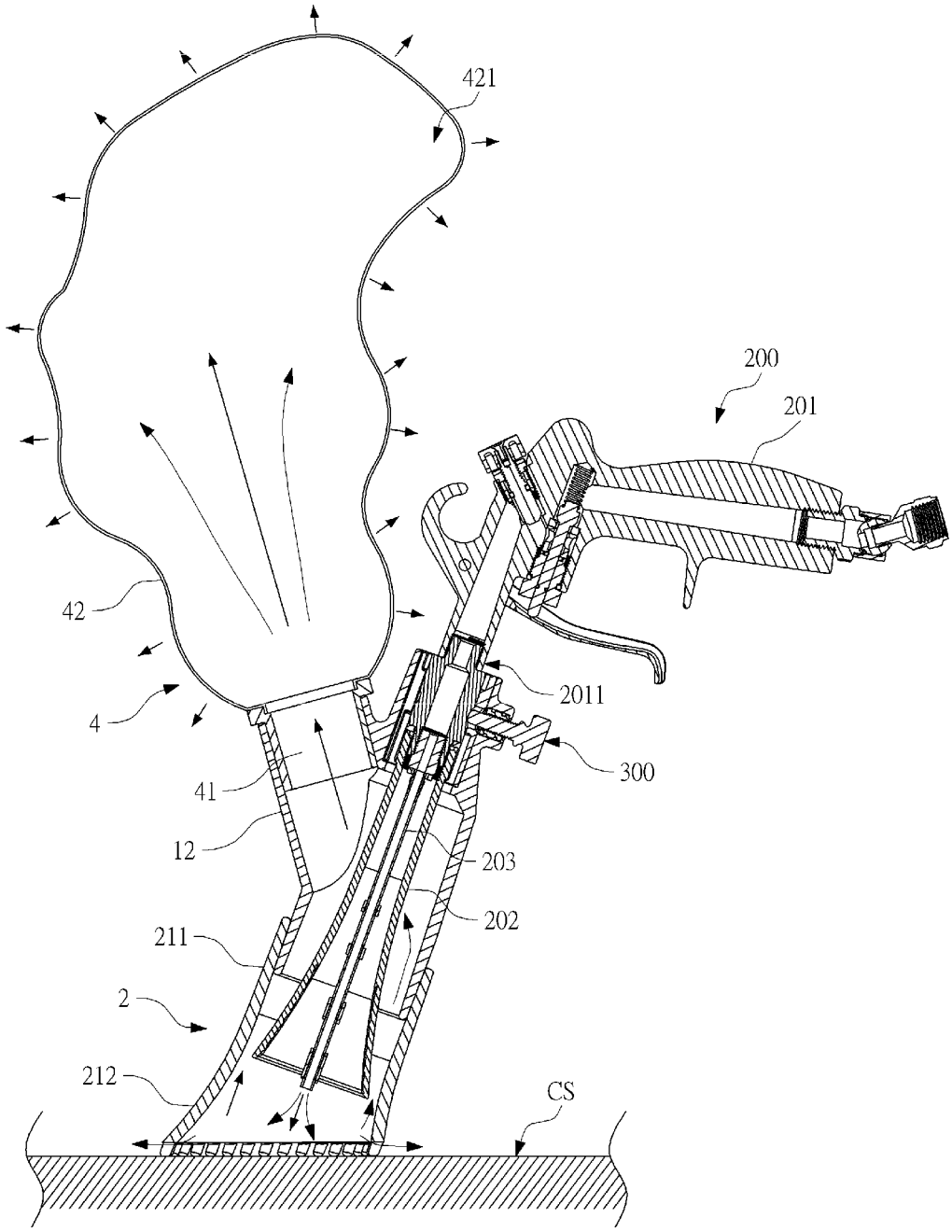
FIG. 9 shows schematically that the combination of FIG. 6 connected with the dust-collecting bag is applied to have the dust collector to adhere an object surface for cleaning.

Referring to FIG. 9, it is shown schematically that the combination of FIG. 6 connected with the dust-collecting bag is applied to have the dust collector to adhere an object surface for cleaning. As shown from FIG. 1 to FIG. 9, the airbrush vacuum kit 100 of this invention can be selectively to assembly the barrel assembling tube 1 to a vacuum adapter tube 3 or a dust-collecting bag 4. If the dust-collecting bag 4 is assembled to the inclined extension tube 12 via the bag connector 41, the dust collector 2 can be still adhered to the object surface CS, and the high-pressure air can be similarly used to spray the dirt off the object surface CS. At this time, since the dust collector 2 is adhered on the object surface CS, thus the air flow toward the object surface CS would be guided by the inner wall of the dust collector 2 to blow the dirt to the inclined extension tube 12, and further into the dust-collecting bag 4. In this embodiment, the dirt can be objects such as dust, powder or chips.

As described above, since the bag body 42 is made of non-woven fabric, thus its breathable function would allow the air in a connecting chamber 421 of the bag body 42 to leave, but the dirt flowed with the air would be stayed. In addition, since the dust collector 4 of this embodiment is furnished with a plurality of raised structures 22, thus even the high-pressure air provided by the fluid spray gun 200 may be over pressurized, the air can be still expelled out via the fluid flow gaps structured by the plurality of raised structures 22 such that possible floating of the dust collector 4 caused by the anti-forcing of the high-pressure air hitting the object surface CS.

Figure 10:
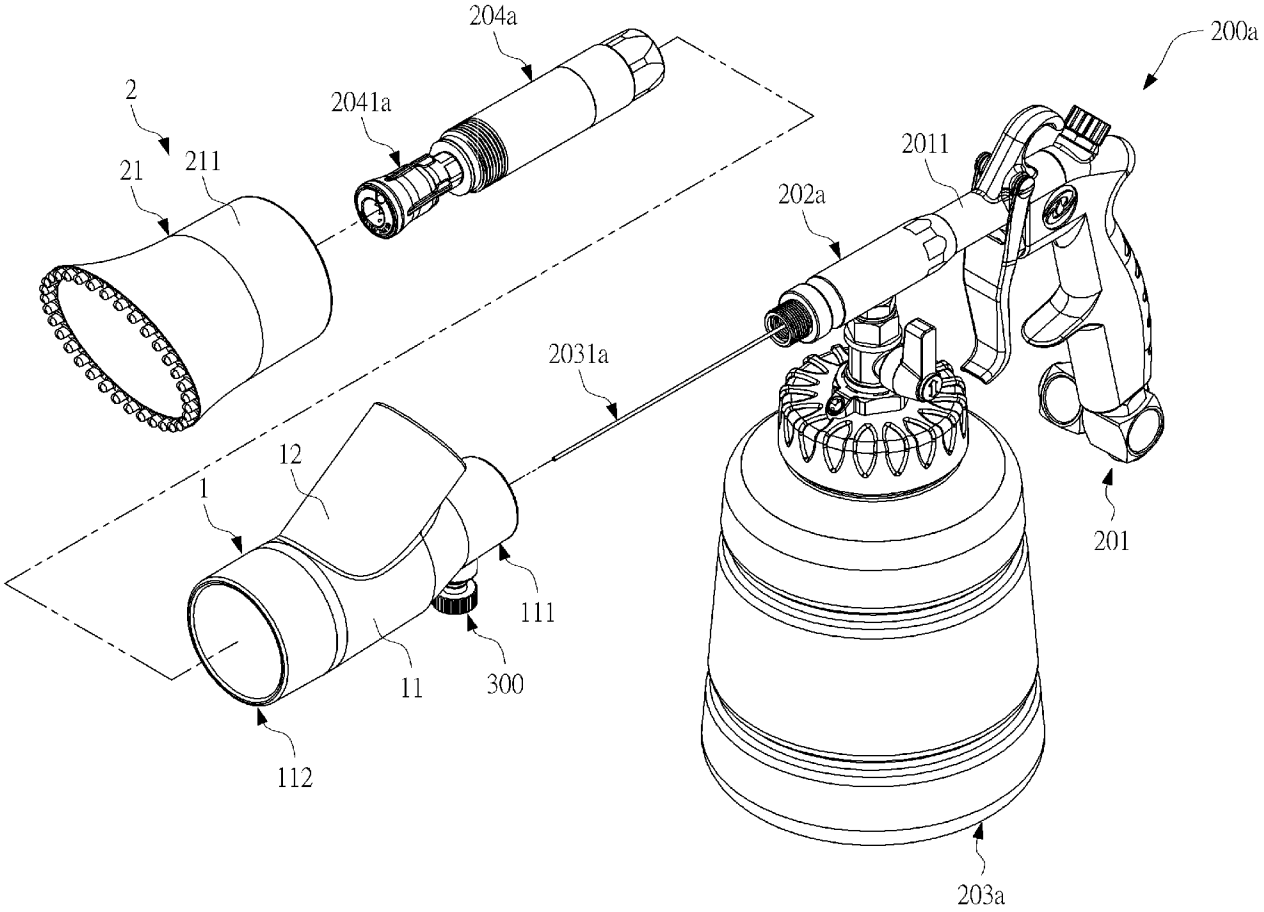
FIG. 10 is a schematic exploded view of a combination of the barrel assembling tube, the dust collector and the vacuum adapter tube of FIG. 1 and another fluid spray gun.

Referring to FIG. 10, a schematic exploded view of a combination of the barrel assembling tube, the dust collector and the vacuum adapter tube of FIG. 1 and another fluid spray gun is shown. In FIG. 10, the airbrush vacuum kit 100 of this embodiment can be assembled to the aforesaid fluid spray gun 200 or another fluid spray gun 200*a*. As shown, the fluid spray gun 200*a* includes the aforesaid gun handle 201, a barrel 202*a*, a liquid supply assembly 203*a* and a cyclone nozzle assembly 204*a*.

Similarly, the gun handle 201 is configured to connect a high-pressure air source. The barrel 202*a* is assembled to the jet port 2011 of the gun handle 201. The liquid supply assembly 203*a* is assembled to the barrel 202*a*, and has an infusion tube 2031*a* extended from the interior of the liquid supply assembly 203*a*, along the barrel 202*a*, and then out of the barrel 202*a*. The cyclone nozzle assembly 204*a* is assembled to the barrel 202*a*, and allows the infusion tube 2031*a* to extend further into the cyclone nozzle assembly 204*a*. The infusion tube 2031*a* extends further and then exposes out of the rotating nozzle 2041*a*.

As described, the first assembling end 111 can be similarly locked to the barrel 202*a* via the lock firmware 300 202*a*, such that the cyclone nozzle assembly 204*a* can extend into the barrel assembling tube 1*a* and the dust collector 2. Thereupon, when the trigger of the gun handle 201 is pulled, the high-pressure air would rotate the rotating nozzle 2041*a*, and simultaneously the fluid would be ejected from the infusion tube 2031*a*.

In addition, since the usage of the combination of the airbrush vacuum kit 100 and the fluid spray gun 200*a* and that of the airbrush vacuum kit 100 and the fluid spray gun 200 are the same, and thus detail thereabout would be omitted herein.

In summary, in usage of the conventional spray gun and the vacuum integrated by the airbrush vacuum kit, it is easy to have the dust collector adhered tightly to the cleaned surface due to the vacuuming provided by the vacuum, and as such efficiency of the associated cleaning task would be greatly reduced. On the other hand, according to the present invention, the airbrush vacuum kit is mainly to dispose a plurality of raised structures to the open end of the dust collector. Thus, when the dust collector approaches the object surface, these raised structures would form a plurality of fluid flow gaps. Thereupon, difficult movement of the dust collector caused by excessive pressure difference would be avoided, and thus the use convenience can be effectively promoted.

While the present invention has been particularly shown and described with reference to a preferred embodiment, it will be understood by those skilled in the art that various changes in form and detail may be without departing from the spirit and scope of the present invention.

What is claimed is:

1. An airbrush vacuum kit, assembled to a fluid spray gun, configured for selectively collecting dirt leaving an object surface or guiding the dirt to a vacuum after the fluid spray gun injects a fluid onto the object surface, the airbrush vacuum kit comprising:

a barrel assembling tube, including:

an assembling-tube body, extending from a first assembling port to a second assembling port along a first direction, the first assembling port being configured for being assembled to a barrel of the fluid spray gun, the second assembling port being spatially connected with the first assembling port; and an inclined extension tube, protruding from the assembling-tube body along a second direction oblique to the first direction;

a dust collector, including:

a collector body, rotationally assembled to the second assembling port, having an open end; and a plurality of raised structures, protruding from the open end by being spaced apart from each other to form a plurality of fluid flow gaps upon when the plurality of raised structures contact the object surface;

a vacuum adapter tube, including:

an adapter-tube body;

a first connecting port, protruding from the adapter-tube body along a third direction, configured for being rotationally assembled to the inclined extension tube upon when the dirt is guided to the vacuum; and a second connecting port, protruding from the adapter-tube body along a fourth direction oblique to the third direction, configured for being assembled to the vacuum; and a dust-collecting bag, configured for being assembled to the inclined extension tube upon when the airbrush vacuum kit collects the dirt.

2. The airbrush vacuum kit of claim 1, wherein the dust-collecting bag includes:

a bag connector, configured for being assembled to the inclined extension tube; and a bag body, connected with the bag connector, having a connecting chamber.

3. The airbrush vacuum kit of claim 2, wherein the bag body is made of non-woven fabric.

4. The airbrush vacuum kit of claim 1, wherein the assembling-tube body has a hollow pipe way for the barrel to penetrate therethrough, the first assembling port has a locking hole, and the locking hole is spatially connected with the hollow pipe way, so that a lock firmware can penetrate through and lock the barrel while the barrel penetrates through the hollow pipe way.

5. The airbrush vacuum kit of claim 1, wherein the second assembling port has a first outer tube wall, the dust collector has a first inner tube wall, and the first inner tube wall and the first outer tube wall are matched to each other.

6. The airbrush vacuum kit of claim 5, wherein the first outer tube wall and the first inner tube wall are individually tapering along the first direction.

7. The airbrush vacuum kit of claim 6, wherein the collector body further includes:

a tube section, extending along the first direction, having the first inner tube wall; and an expanding section, connected spatially with the tube section, gradually expanding along the first direction.

8. The airbrush vacuum kit of claim 7, wherein the inclined extension tube has a second inner tube wall, the first connecting port has a second outer tube wall, and the second outer tube wall and the second inner tube wall are matched to each other.

9. The airbrush vacuum kit of claim 8, wherein the second inner tube wall is gradually expanded along the second direction, the second outer tube wall is tapering along the third direction, and the second direction and the third direction are opposite to each other upon when the first connecting port is assembled to the inclined extension tube.

* * * * *